US005803317A

United States Patent [19]

Wheeler

[11] Patent Number: 5,803,317

[45] Date of Patent: Sep. 8, 1998

[54] HEATED DISPENSING APPARATUS

[76] Inventor: James R. Wheeler, 1138 Bordeaux St., Pleasanton, Calif. 94566

[21] Appl. No.: 681,186

[22] Filed: Jul. 22, 1996

Related U.S. Application Data

[63] Continuation-in-part of Ser. No. 596,868, Feb. 9, 1996.

[51] Int. Cl.[6] ..... B65D 37/00

[52] U.S. Cl. ..... 222/214; 222/95; 222/105; 222/131; 222/146.5

[58] Field of Search ..... 222/1, 95, 105, 222/212, 214, 333, 146.5, 131, 146.2

[56] References Cited

U.S. PATENT DOCUMENTS

| | | | |
|---|---|---|---|
| 3,212,681 | 10/1965 | Weikert | 222/183 |
| 3,297,206 | 1/1967 | Scholle | 222/105 |
| 3,520,451 | 7/1970 | Ashizawa | 222/148 |
| 4,094,446 | 6/1978 | Brutsman | 222/146 |
| 4,544,085 | 10/1985 | Frazer | 221/146.4 |
| 4,651,898 | 3/1987 | Bell | 222/129 |
| 4,796,788 | 1/1989 | Bond | 222/94 |
| 5,000,351 | 3/1991 | Rudick | 222/105 |
| 5,040,700 | 8/1991 | Compton | 222/146.5 |
| 5,102,015 | 4/1992 | Barnard et al. | 222/214 X |
| 5,142,610 | 8/1992 | Augustine et al. | 222/146.5 X |
| 5,249,706 | 10/1993 | Szabo | 222/20 |
| 5,349,825 | 9/1994 | Duke | 69/69 |
| 5,366,308 | 11/1994 | Crispino | 401/1 |

*Primary Examiner*—Gregory L. Huson

[57] ABSTRACT

A dispenser for dispensing products at elevated temperature, particularly products that do not flow well at room temperature but will flow at elevated temperature, allows packaging of the products in a container, such as a flexible plastic bag, with a discharge tube extending therefrom. The dispenser includes a receptacle with an outlet opening in the lower portion thereof and a pump adjacent to the outlet opening. A container of product is received in the receptacle with the discharge tube extending through the outlet opening and through the pump. A heater is provided for heating the product in the container in the receptacle and in the discharge tube passing through the pump and maintaining it at the desired elevated temperature. The product is dispensed by operating the pump to force heated product to flow through and from the discharge tube.

7 Claims, 7 Drawing Sheets

HEATED DISPENSING APPARATUS

RELATED APPLICATION

This application is a continuation-in-part of copending application Ser. No. 596,868 filed Feb. 9, 1996 entitled "Heated Dispensing Apparatus".

BACKGROUND OF THE INVENTION

1. Field

The invention is in the field of dispensing viscous and semi-viscous products, particularly food products, that do not flow well at room temperature, but flow at higher temperatures. It is also in the field of dispensing heated products.

2. State of the Art

Heated dispensers for dispensing various different liquid and semi-liquid hot food products are well-known in the art and are widely used in restaurants, convenience stores and other commercial eating establishments. Most of the food products requiring such dispensers, such as cheese sauce and ice cream toppings, are very viscous at normal room temperatures and it is common practice to provide heaters for heating the product in a product receptacle to maintain it in a heat softened and flowable condition. Ordinarily these dispensers have a pump which extends down into the heated product in the receptacle to force the heated product through a spigot which extends to outside the receptacle.

The use of a pump inside a heated product receptacle and the heated spigot tube through which the product is dispensed have several disadvantages:

A. The pump, receptacle and spigot, because they are in direct contact with the food, must frequently be dismantled and cleaned because of concern over contamination, especially when used with dairy products which are susceptible to bacterial spoilage. In fact, many states require a daily cleaning of dispensers which have dairy products dispensed through them.

B. Products most often used in these dispensers become more viscous and tend to congeal as they cool off. Not infrequently, the pump will have to be soaked to loosen encrusted material inside of it. Even after soaking in hot water, food particles are often very hard to remove from the pump because of the long tube shape and mechanisms of the pump, thus creating a greater possibility of bacterial contamination.

C. While the prior art has solved the problem of needing to use costly waterproof electrical parts to heat the spigot by having the heat source for the spigot independent of the spigot, there remains the problem of properly cleaning a spigot which generally is a tube of one-quarter inch diameter and about twelve inches long. This spigot is in constant contact with a heat source which must maintain the product in the spigot generally at at least one hundred and forty degrees Fahrenheit. When these products are heated to these temperatures, product often adheres to the insides of the spigot. Proper cleaning of such spigots is difficult because of collected product build up and the shape of the spigots.

D. The product receptacle cleaning, as a general rule, cannot be accomplished without at least withdrawing the pump subassembly from within the product receptacle. Ordinarily the pump subassembly is located inside the dispenser and has the bottom of the spigot tube attached to it. Dismantling of many dispenser parts is required to remove the pump subassembly in order to clean the product receptacle. Any electrical connection, waterproof or otherwise, inhibits such operation.

E. The pump, receptacle, and spigot are in direct contact with the food product, therefore they must be made of food quality materials and since these materials must conduct or are in contact with excessive heat, expensive stainless steel is commonly used for these parts of the dispensers.

F. Many prior art heated pump dispensers have a spigot through which the product is dispensed which extends outward from the receptacle. These spigots must maintain product therein at a temperature that is generally in excess of one hundred and forty degrees. Having a spigot at these temperatures exposed to the user of the dispenser can cause burns to a user who simply touches the spigot by accident.

G. Problems have also been encountered in maintaining the product in the spigot in a heat-softened condition. Many prior art patents relate to means for maintaining heat in the spigot (see, for example, U.S. Pat. Nos. 4,094,446 and 5,040,700).

Products in a sealed bag with a spout for dispensing, such as bag-in-box packages, have been in use for a number of years. Prior art shows bulk milk dispensers, post mix soft drink syrups, and even wine packaged in this way. One of the first of these packages used commercially is illustrated in U.S. Pat. No. 3,173,579. These packages have been used mainly for holding and dispensing liquids which will readily flow by gravity from the bag at chilled or at room temperature when the dispensing valve thereof is opened. However, they are not ordinarily used for containing and dispensing substances which will not readily flow by gravity, such as viscous and semi-viscous products because special equipment, such as pumps or pressure chambers are required.

U.S. Pat. No. 4,796,788 shows a bag-in-box packaging and dispensing system used for viscous and semi-viscous products. The dispenser uses a special two chamber bag and pressure to force the product in the bag out of the bag and product receptacle.

The use of a pressure extruding system to dispense product has several disadvantages:

A. The cost of producing a bag with two chambers is very expensive. One chamber is needed for product, and has a tube extending therefrom through which product is dispensed. A second chamber is needed for air to be pumped into, and requires a valve which is attached to an air hose.

B. The bag is also very costly because the strength of the material needed to handle the pressure that is used to extrude the product.

C. The dispenser price is extreme as a result of the need for an air compressor, tubes and electrical components.

OBJECTS AND ADVANTAGES

It is, therefore, the principal objective of the present invention to provide a novel and improved dispenser for heat-softenable or liquid food or other products. The dispenser pumps a flowable product out of a heated container, such as a bag, through a flexible discharge tube with elastically deformable walls. Flow of the product is controlled by activation of a pump cooperable with the discharge tube.

The second objective is to reduce the amount of cleaning needed to maintain product and dispenser in a sanitary condition. This is done by keeping the product enclosed in a disposable container, such as a storage bag, and dispensing tube. This prevents the product from coming in direct contact with the dispenser parts.

Another objective is to provide easier cleaning procedures. Since the invention allows the product to be maintained in a disposable container, there is no requirement for dismantling and cleaning the pump. The operator simply removes the heating receptacle lid and releases the stator of the pump housing to pull out the empty product bag and discharge tube and place a new bag with discharge tube in the product receptacle with the discharge tube going through the pump housing.

It is an objective of this invention to provide a heated dispenser that is inexpensive to produce. As a result of the food product not coming in direct contact with dispenser parts, the dispenser of the invention can be made of materials that are less expensive than those required by dispensers in which food comes in contact with the dispenser parts.

Another object of this invention is to provide a means for heating the product and dispensing it wherein there is no danger of a user being burned by a device used to attempt to maintain a warm spigot during periods of nonuse. Since there is no spigot or other external part that requires heat, the user has less opportunity to be burned. All heated parts are covered by insulation and an outer plastic shroud.

It is an object of this invention to provide a method and apparatus for maintaining the dispenser tube at a temperature so that the product within the tube remains at the recommended and desirable consistency and temperature, even during periods when the dispenser is not being continuously used. To accomplish this the dispenser tube is heated to the desired temperature along substantially its entire length. The product is thereby maintained at a uniform desired temperature.

Further objects are to provide a combination heater and dispenser which is simple, versatile, sanitary, safe, compact, lightweight and even decorative in appearance.

The foregoing and other objects and advantages of this invention will become apparent to those skilled in the art upon reading the following description of the preferred embodiment in conjunction with the appended drawings.

SUMMARY OF THE INVENTION

According to the invention, a product which is to be dispensed at an elevated temperature, such as a product which does not flow well at room temperature but will flow at elevated temperature, is packaged in a container having a discharge tube extending therefrom which opens into the container. A dispenser for such product includes a receptacle having an outlet opening in the front lower portion thereof for receiving the container of product therein and positioning the container so that the discharge tube extends from the front lower portion of the container through the outlet opening. The receptacle may have substantially vertical side walls, front wall with discharge tube slot, rear end wall, and a sloped bottom wall with outlet opening. The product container is then received in the receptacle and is supported by the side and bottom walls so that the discharge tube extends from the front bottom of the received container. In my referenced copending application, a valve is provided which when open, opens the discharge tube so that heated product can flow through the tube and will be dispensed therefrom. However, some products, while flowable at elevated temperature, do not freely flow at such temperature so will not flow adequately by gravity. In such instance, it is necessary to pump such products from the heated container. Further, with merely a valve, if the product does flow adequately under the influence of gravity, the product will flow as long as the valve is held open. In some cases it may be desirable to dispense a measured portion of product and a pump can be controlled to pump such measured portions. In the current invention, a pump, preferably secured beneath the receptacle so that the discharge tube passes through the pump after it extends through the outlet opening, cooperates with the discharge tube to provide flow of product therethrough and therefrom when the pump is activated to dispense the product. The pump incorporates a rotor which is driven at a determined speed by an electric motor, the rotor being provided with pinch rollers that are mounted in the periphery of the rotor for rotation about axes parallel to the axis of rotation of the rotor. The discharge tube with product confined within being supported on a supporting bed of a stator positioned proximate to the rotor periphery.

Means are provided to heat the product in the container and in the discharge tube as it passes through the pump to maintain the product in the container and discharge tube in a desired temperature range. If the product is one that does not flow well when at room temperature, but flows at an elevated temperature, the desired temperature range will keep the product at a temperature at which the product will flow from the container through the discharge tube when the pump motor is activated. As currently preferred, the portion of the receptacle adjacent to the received container is made of a heat conducting material and an electric heating element is positioned to heat the receptacle walls and bottom. The heating element can be positioned to heat the bottom and side walls. The heat from the receptacle walls adjacent to the product container serve to heat the container and product therein. The pump preferably has a portion of heat-conducting material substantially surrounding the discharge tube. This portion of the pump is heated with the heat therefrom heating the discharge tube and product therein. A separate electrical heating element may provide heat to the pump or the heated portion of the pump may be located to contact the heat-conductive walls of the receptacle around the outlet opening so that heat is conducted to the pump from the heated bottom walls of the receptacle. The receptacle, and in some cases the pump, are covered by insulating material to both reduce the heat loss, and, importantly, reduce heat transfer to the outside of the dispenser and to exposed receptacle and pump parts to substantially eliminate the risk of burns to a user.

The discharge tube is preferably flexible and the pump preferably operates by the pinch rollers progressively impinging on the discharge tube as the rotor rotates to compress the discharge tube against the arcuate stator supporting bed with a travelling pinch effect. In this manner, a determined volume of product is trapped within the discharge tube between adjacent travelling pinches of the rollers, and is moved axially through the discharge tube, product flowing therethrough at a rate determined by the speed of rotation of the rotor to dispense the product.

When all dispensable product is dispensed from the container, the container with attached discharge tube is removed from the dispenser and replaced with a new, full container of product. Since the product does not contact the dispenser directly, difficult cleaning of the dispenser is avoided.

The container of product to be dispensed is advantageously a closed flexible bag of product with a flexible discharge tube extending therefrom and closed at the outer end of the tube so that the container is completely sealed for storage. When inserted into the dispenser with the discharge tube passing through the pump, the outer end of the discharge tube is cut off to open the end of the tube. Product movement through the tube is then controlled by the pump. As product is dispensed, the bag collapses.

THE DRAWINGS

The best mode presently contemplated for carrying out the invention is illustrated in the accompanying drawings, in which:

FIG. 1 is a perspective view of a filled container of product to be dispensed;

FIG. 2, a fragmentary enlarged perspective view of the discharge tube and its connection to the container;

FIG. 3, a perspective view of a dispenser of the invention showing the outer shroud;

FIG. 4, a perspective view of the dispenser of the invention with the shroud removed;

FIG. 5, an enlarged perspective view showing only the pump mechanism;

FIG. 6, an enlarged front elevation showing the pump mechanism of FIG. 5;

FIG. 7, an enlarged fragmentary vertical section of the product receptacle and pump mechanism taken on the line 7—7 of FIG. 4, showing the motor and motor shaft in elevation and not showing the rotor;

FIG. 8, an enlarged fragmentary front elevation of the pump mechanism of FIG. 6 showing the mechanism in open position to receive a container discharge tube in the pump, and showing the container discharge tube;

FIG. 9, a view similar to that of FIG. 8 showing the mechanism in closed position with the discharge tube therein; and FIG. 10, a fragmentary longitudinal section taken on the line 10—10 of FIG. 4.

DETAILED DESCRIPTION OF THE ILLUSTRATED EMBODIMENTS

This invention is generally directed to the dispensing of a liquid or viscous product packaged in a container such as a disposable, flexible bag 12, and is particularly advantageous when the product to be dispensed does not flow well at room temperature but when heated to a certain temperature range will become flowable. Various substances may be packaged in bulk according to this invention, including food stuffs such as cheese sauce, dessert toppings, syrups, hot fudge, etc., or non-food stuffs such as glues, oils, and grease. Various other viscous or semi-viscous products may also be so packaged, some of which may be processed and filled aseptically. According to this invention, the flow of the product during dispensing is greatly aided by heating the product to a flowable condition.

Figure 1:
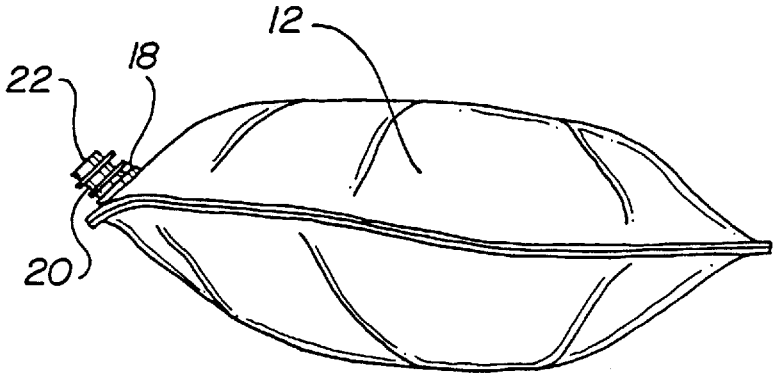
Figure 2:
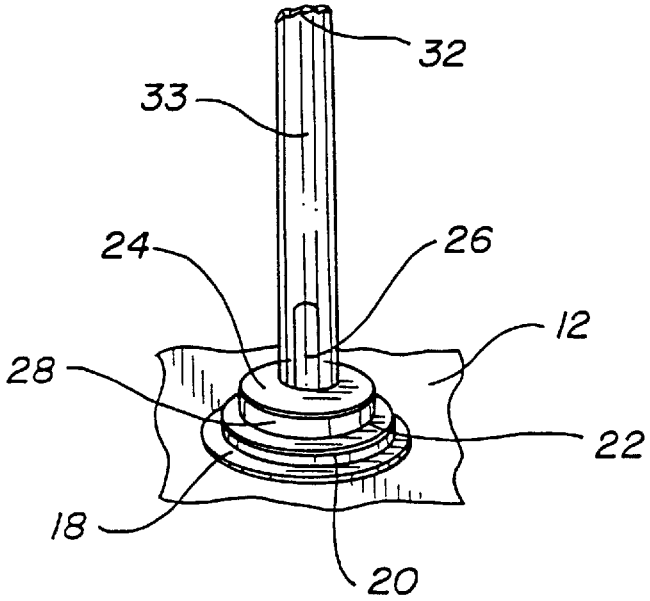

Referring to the drawings of FIGS. 1 and 2, a disposable, flexible bag 12 made of material which can withstand applied heat contains an aperture 18 through which product is discharged. A port assembly 20, adapted for fluid tight connection to a thin-walled flexible bag, is secured to aperture 18. A cap 24 is locked to the port assembly 20 by a downwardly sloped circumferential lip on the top surface of the cap 24, which is tightly received in the complementary groove 22 in the inner surface of the port assembly 20, thus providing a fluid tight seal between the port assembly 20 and the cap 24. The cap 24 includes a nipple 26 to which is secured a flexible discharge tube 30 as by the resilient tube having an inner diameter slightly less than the outer diameter of the cap's nipple 26. The discharge tube 30 is crimped (sealed) at the outer discharge end 32 to provide a sealed container of product for storage and shipment and to prevent product from being discharged from the bag 12 or tube 30 until an operator is ready. Once the bag 12 and tube 30 have been properly placed in a dispenser, the operator cuts the crimped end portion 32 of the discharge tube 30 to allow the flow of product.

Figure 3:
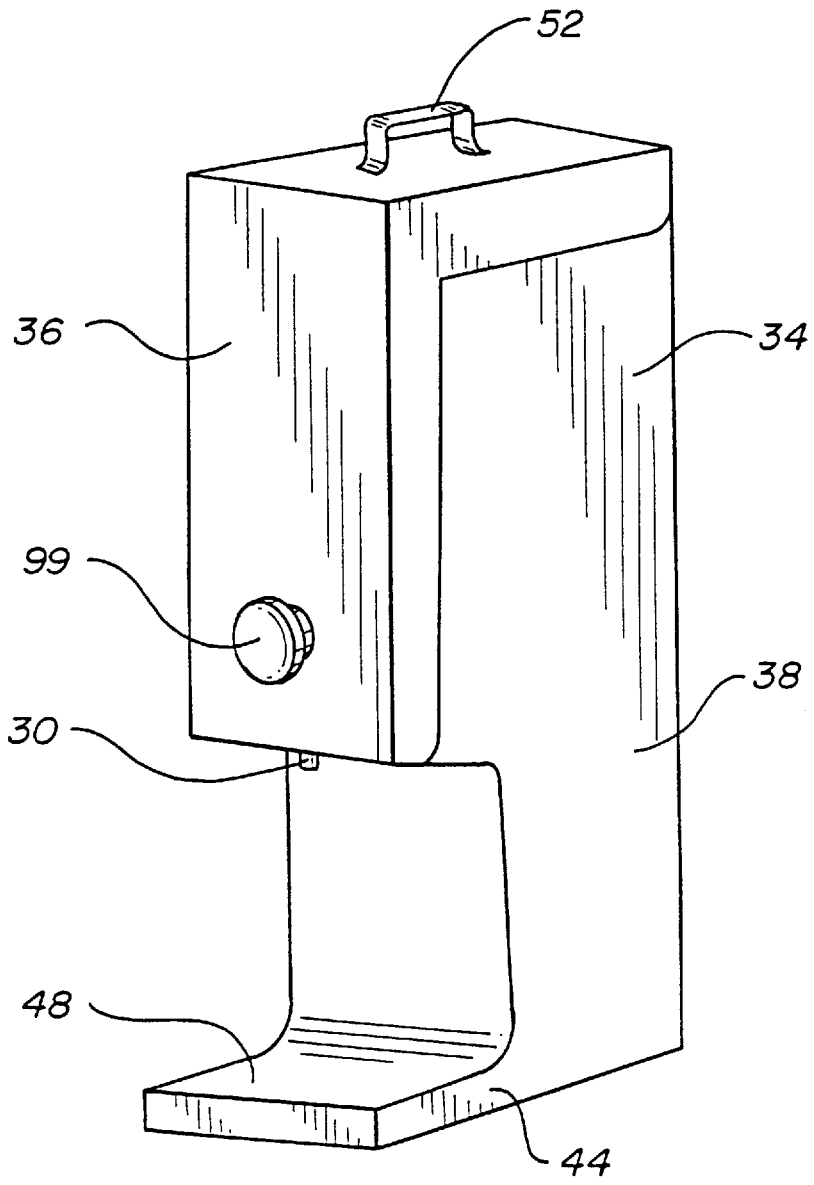

The present invention provides a heated, pump type dispenser for products packaged in a disposable, flexible bag 12, or similar container, which has a flexible and resilient discharge tube 30 extending therefrom. In the embodiment of dispenser shown in FIG. 3, the pump type dispenser includes a stationary outer shroud 34 made of washable food grade material which is attached to a dispenser frame 40, FIG. 4, made of rigid material. The shroud 34, FIG. 3, includes a hood 36 with handle 52, upstanding side walls 38, and a bottom 44 containing a drip tray 48.

Figure 4:
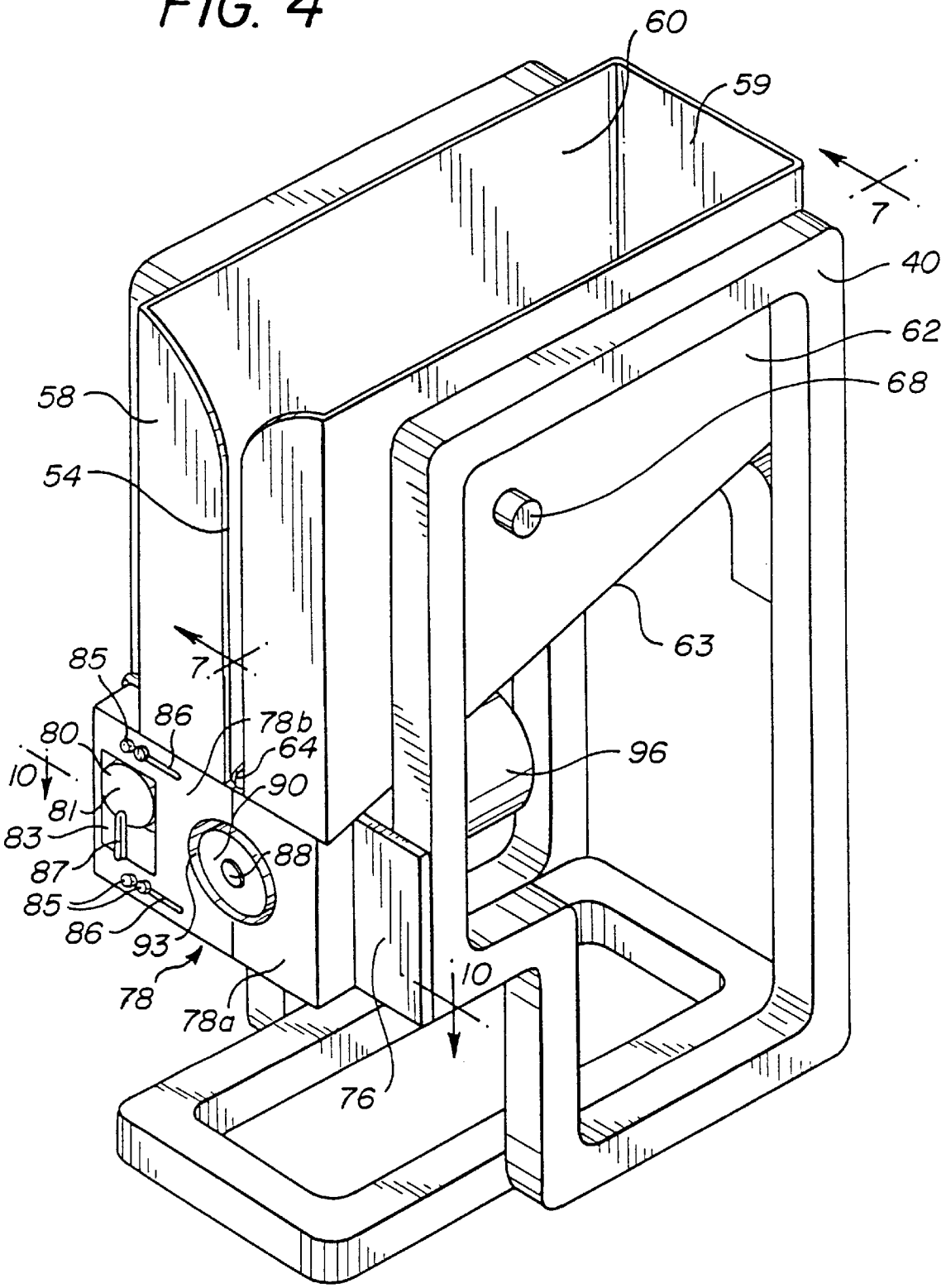
Figure 5:
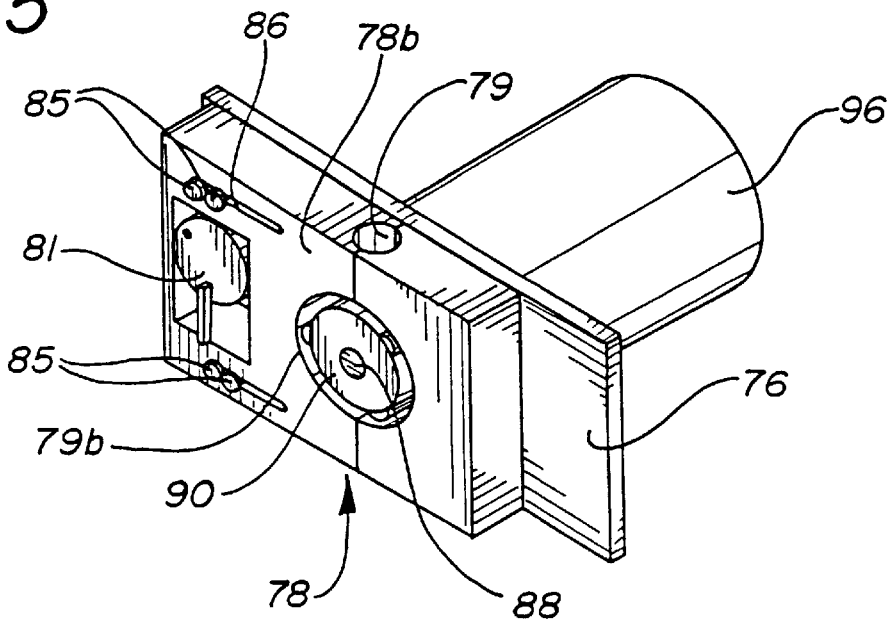
Figure 6:
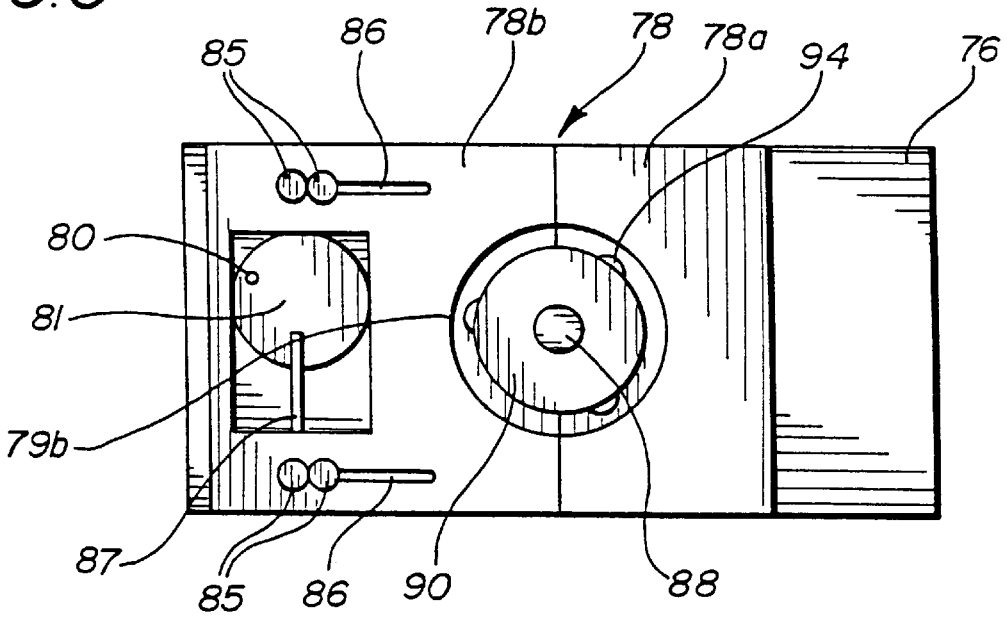

A product receptacle 60, FIG. 4, for receiving a container of product therein, is mounted to the upper portion of dispenser frame 40. The product receptacle 60 includes substantially vertical front wall 58, back wall 59, and side walls 62, and sloped bottom wall 63, FIG. 7, with an outlet opening 64, located at the lower front portion of the sloped bottom wall 63, so that product in a container such as flexible bag 12 will readily drain from the product receptacle 60. A slot 54 extends vertically from the top of front wall 58 to outlet opening 64 at the bottom of front wall 58 and bottom wall 63. The outlet opening 64 is slightly larger than the outside diameter of the container's discharge tube 30.

Figure 7:
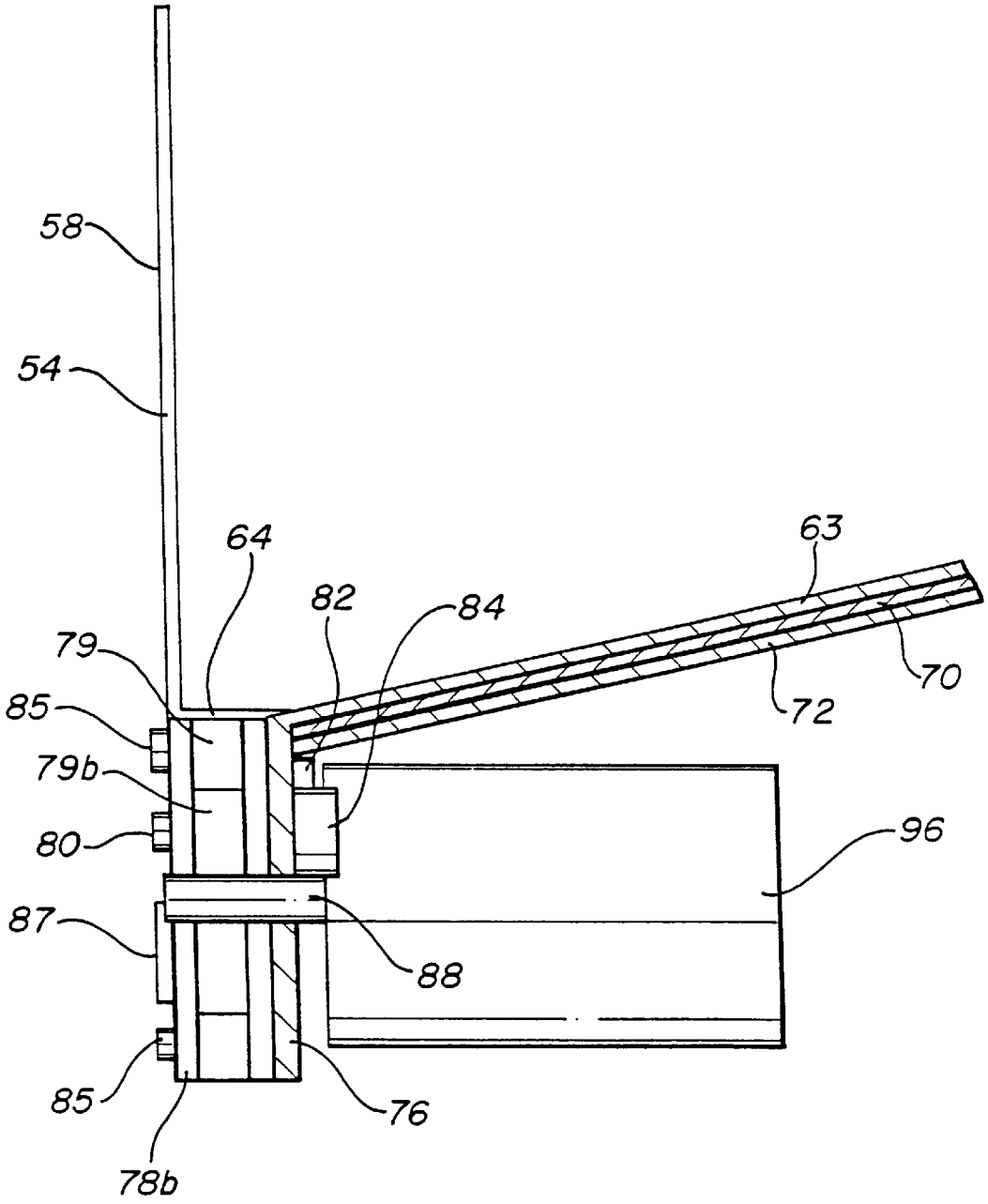

An electrical heater 70, FIG. 7, is provided for heating the product contained in the bag 12 when placed in the product receptacle 60. The receptacle side walls 62, rear wall 59, and bottom wall 63 are made of a heat-conductive material, such as aluminum or other metal. The heater 70 is preferably of the flexible or strip type and is disposed in contact with the bottom wall 63 of the product receptacle 60. Thus, heat applied to the bottom wall 63 of receptacle 60 heats both the bottom wall 63, side walls 62, and back wall 59 and the heat is transferred through said walls 59, 62, and 63 to a product container received in receptacle 60 to heat the product in the container. If desired, front wall 58 may also be made of a heat-conductive material. While the heater is shown arranged to directly heat only bottom wall 63, i.e., is in direct contact with only bottom wall 63, it could be arranged to also or instead directly heat side walls 62, back wall 59, and/or front wall 58.

A temperature control means, such as a thermostat 68, FIG. 4, is electrically connected in normal manner in an electrical control circuit with heater 70, and the thermostat 68 is arranged to control the heater 70 in a manner to cause the heater 70 to heat a received product container and product therein to a predetermined product temperature range in which the product is heated to a flowable condition. For example, for many dessert toppings, syrups, hot fudge and the like, a temperature in the range of one hundred ten to one hundred twenty degrees fahrenheit is suitable. Thermal insulation 72 is placed around side walls 62, back wall 59, and bottom wall 63 over heater 70 to decrease heat loss and to reduce likelihood of burns to a user who may otherwise touch heater 70. If front wall 58 is made of heat-conductive material, it too may be covered by insulation, but slot 54 should remain open.

A pump base 76, made of heat conducting material, and which is specifically adapted to support and positionally locate a two piece pump housing 78, is mounted on dispenser frame 40 beneath product receptacle 60. A passage 79 aligned with outlet opening 64 extends through pump housing 78 to receive the container discharge tube 30 when a container is received in receptacle 60. Pump base 76 and pump housing 78, also made of heat conducting material and through which container discharge tube 30 passes, are heated and heat from pump housing 78 keeps discharge tube 30 and product therein within the predetermined temperature range. Pump base 76 may be in heat conducting contact with receptacle bottom wall 63, as shown in FIG. 7, so it and pump housing 78 are heated by heat transferred from product receptacle bottom wall 63, or a separate pump electrical heater 82, also as shown in FIG. 7, may be provided for separately heating pump housing 78. The pump heater 82 is preferably of the cartridge type and is inserted directly into pump base 76, but could be of strip type disposed in contact with the pump base 76. Thus, heat applied to the pump base 76 is transferred to pump housing 78 and transferred through the pump housing 78 to heat the container discharge tube 30 and product therein as it passes through such pump.

Where a separate pump base heater is used, a temperature control means for the pump base heater, such as a pump base thermostat 84, FIG. 7, is electrically connected in normal manner in an electrical control circuit to the pump base heater 82. Thermostat 84 is arranged to control the pump base heater 82 in a manner to maintain the product in the discharge tube 30, passing through the pump housing passage 79, in a flowable condition.

The pump housing 78 includes two pieces 78*a* and 78*b* which form a stator surrounding a rotor 90 mounted on and for rotation with a drive shaft 88 that extends from motor 96 mounted on pump base 76 and operable at a selected constant speed, an appropriate gear reduction (not shown) being incorporated in the drive in the event that it is found necessary. Pump piece 78*a* is stationary, while pump piece 78*b* is slidably mounted on pump base 76 to slide toward and away from rotor 90. Passage 79 is formed in the mating ends of pieces 78*a* and 78*b* and extends around rotor 90 in slidable piece 78*b*, as at 79*b*. The motor 96 may either be a selectable speed continuously rotating motor, a stepping motor, or any other device producing a determined constant angular velocity of drive shaft 88 or a controllable amount of angular rotation of drive shaft 88.

Figure 8:
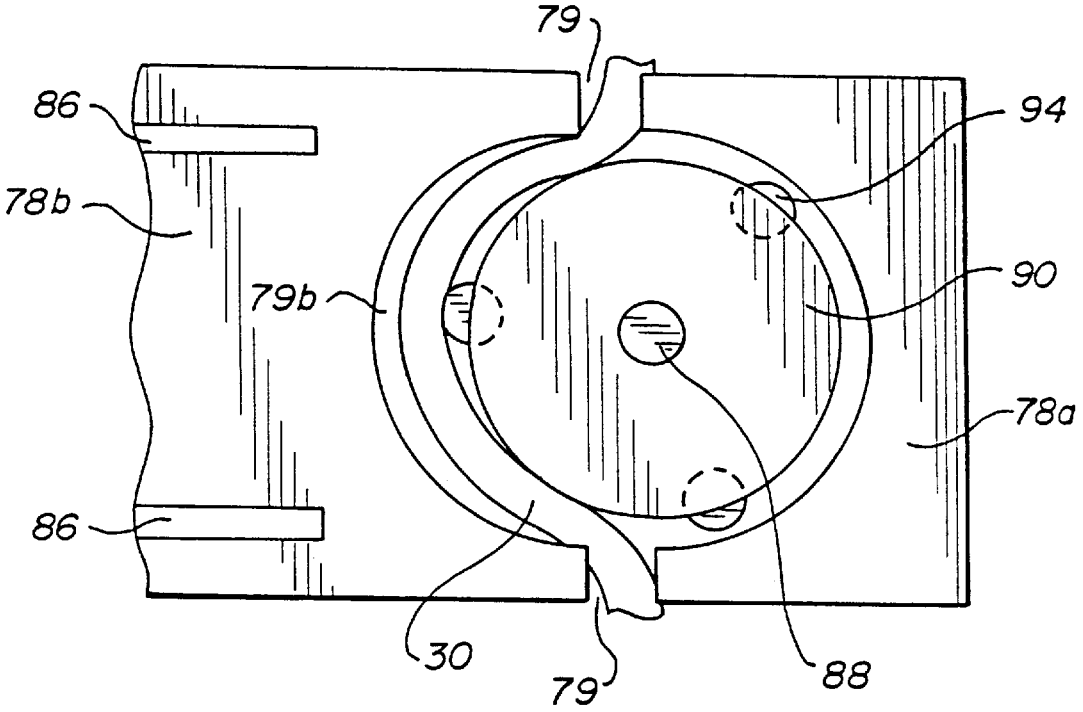
Figure 9:
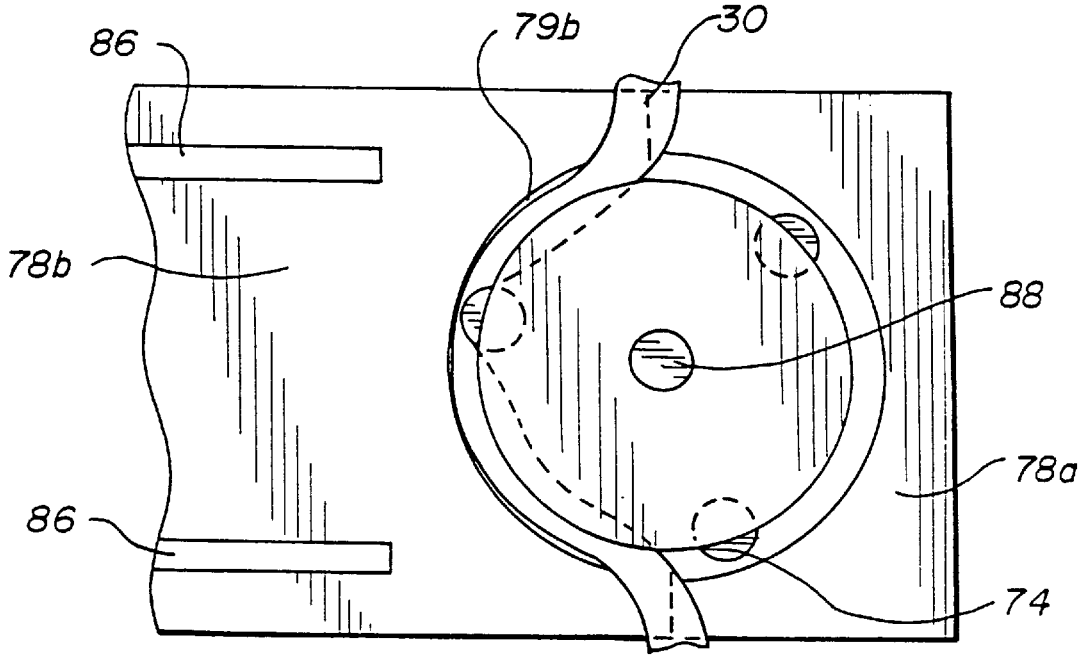
Figure 10:
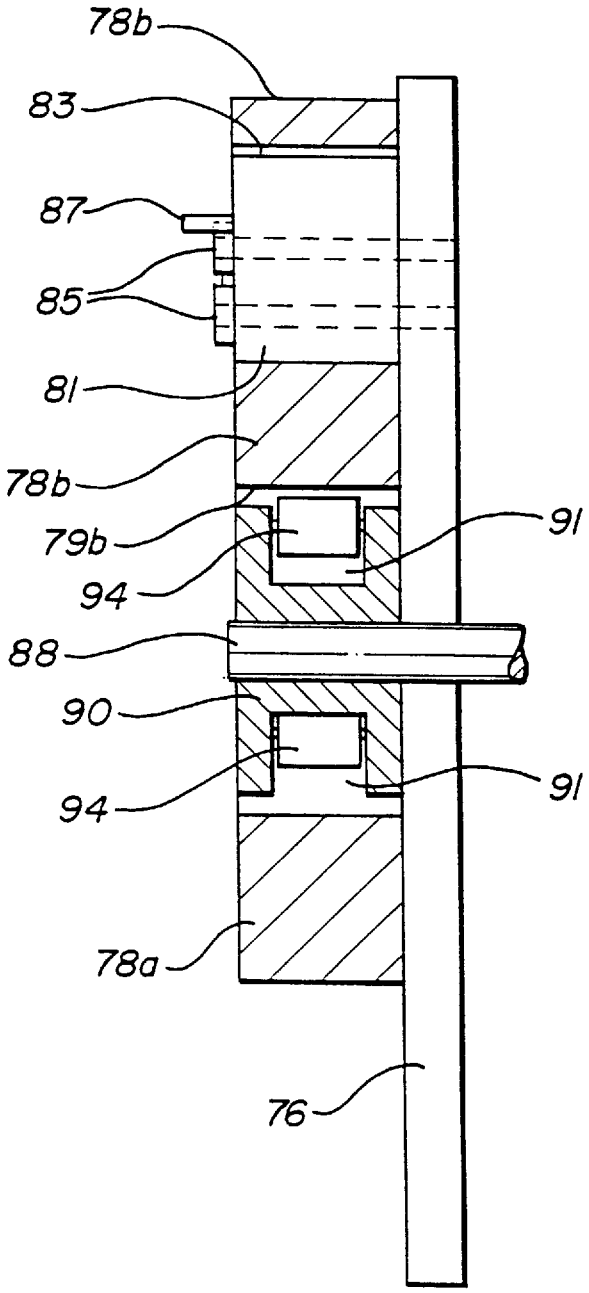

Rotor 90 has a groove 91 therein, FIG. 10, extending circumferentially therearound. A plurality of pinch rollers 94 are mounted in groove 91 for free rotation, evenly distributed about the circumference of rotor 90, as illustrated in FIGS. 8 and 9. While three pinch rollers are shown and work well, more or fewer pinch rollers could be used. Preferably, pinch rollers 94 are all of the same diameter and are arranged with their central axes near the outside edge of rotor 90 so that a portion of each roller extends radially beyond the edge of rotor 90. The axis of rotation of each pinch roller is parallel to the longitudinal axis of the drive shaft 88. Thus, upon rotation of the rotor 90, the respective rollers will orbit in a plane about the axis of the drive shaft 88, and if frictionally restrained during rotation of the rotor 90, will rotate about their own axes.

Pump piece 78*b* is mounted for sliding movement toward or away from rotor 90 by shoulder bolts 85 passing through slots 86 in housing piece 78*b* and screwed into pump base 76. Shoulder bolts 85 are sized to hold housing piece 78*b* in place against pump base 76 to allow heat transfer from pump base 76 to pump piece 78*b*, but to allow it to slide on shoulder bolts 85 as allowed by slots 86. A disk 81 is eccentrically rotatably mounted by shoulder bolt 80 to form a cam within rectangular opening 83 in pump piece 78*b*. Cam handle 87 extends from cam 81 to enable a user to rotate cam 81. Rotation of cam 81 about bolt 80 in opening 83 causes pump piece 78*b* to move toward or away from rotor 90.

As indicated above, passage 79 for receiving a container discharge tube 30 extends between pump pieces 78*a* and 78*b* and around rotor 90 in piece 78*b*. With piece 78*b* slid away from rotor 90 as shown in FIG. 8, passage 79 is open between pieces 78*a* and 78*b* and passage portion 79*b* around rotor 90 is open between piece 78*b* and rotor 90 so that a discharge tube 30 extending from a container placed in receptacle 60 can be inserted into passage 79 as shown in FIG. 8. With discharge tube 30 in position in passage 79 and pump piece 78*b* slid into position toward rotor 90 and against piece 78*a* as shown in FIG. 9, the spacing between passage portion 79*b* and rotor 90 is such that rollers 94 will compress or pinch tube 30. As rotor 90 rotates, respective rollers 94 will contact and pinch tube 30 and move along tube 30 forming a peristaltic pump with the product confined within the bore of discharge tube 30 being propelled longitudinally along the discharge tube. Rotation of rotor 90 thus pumps product from a container through discharge tube 30 and out the open end of discharge tube 30. Generally a separate valve will not be provided so that the pinch roller has to pinch discharge tube 30 sufficiently to block flow of heated product through the tube by gravity when the pump is not operating. Where the pinch rollers block tube 30 against product flow, the length of the tube adjacent rotor 90 and the number of pinch rollers have to be coordinated and selected so that a pinch roller is always pinching the tube regardless of the position of rotor 90.

To prepare the dispenser to dispense product, cam 81 is rotated in a clockwise direction to slide pump piece 78*b* away from rotor 90. Hood 36 is removed and bag 12 with product therein is placed in the product receptacle 60 with discharge tube 30 extending through the bottom of slot 54. Tube 30 is then positioned to extend through outlet opening 64 at the bottom of receptacle 60 and through passage 79 in pump housing 78. The crimped or closed end 32 of discharge tube 30 protrudes from passage 79 at the bottom of the pump housing 78. Pump housing 78 is closed by counter clockwise rotation of cam 81 which moves piece 78*b* toward rotor 90 so pincher rollers 94 will compress discharge tube 30. The exposed crimped end of the discharge tube 30 is then cut off and hood 36 replaced. Once the product in the bag 12 in the product receptacle 60 is heated to the proper temperature range so the product can flow, the product is dispensed from discharge tube 30 by pushing button 99, FIG. 1, to activate pump motor 96 causing rotor 90 to rotate until the desired amount of product is dispensed. The motor 96 is then stopped to stop flow of product. When more product is to be dispensed, the button 99 is pushed again and motor 96 is activated to again pump the tube and allow discharge of product. The receptacle and pump maintain the desired temperature range of the product in the bag and discharge tube during the time the product is to be available for dispensing. When all product in the bag is dispensed, pump piece 78*b* is moved away from rotor 90 to release discharge tube 30, hood 36 is removed, and bag 12 with discharge tube 30 is removed from the receptacle and a new bag of product inserted. Since the product remains in the bag and discharge tube, separated from the dispenser parts and pump, substantially no clean up of the dispenser or pump is required.

Pump motor 96 may be operated directly by button 99 which operates a switch so that the motor operates when button 99 is depressed, or it may be operated by control circuitry initiated by button 99 to dispense a preset amount of product each time button 99 is operated.

While various parts have been shown mounted for sliding movement or rotational movement using shoulder bolts, various other mounting means could be used. For example, sliding parts could be mounted using dove-tailing, T-grooves, etc., while any type of pin or shaft could be used to provide rotational mounting.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A dispenser for products which are to be dispensed at elevated temperature and wherein the product is contained in a flexible bag having an outlet with a flexible discharge tube extending therefrom, comprising:

(a) a receptacle having an outlet opening in the lower portion thereof for receiving said bag with the discharge tube extending through the outlet opening, said receptacle having substantially vertical side walls and sloped bottom wall, the sloped bottom wall terminating in the outlet opening;

(b) a heating element for heating said sloped bottom wall adjacent said bag when received in the receptacle to a desired temperature range and maintaining the temperature of the product in that temperature range for a desired period of time, said vertical side walls and bottom wall being comprised of a heat conducting material and said heat being conducted through said sloped bottom wall to said side walls:

(c) a pump being positioned to conductively receive heat from said vertical side walls and bottom wall of said receptacle, said pump further including (i) a housing being comprised of heat conducting material, (ii) a rotor supported in said housing for rotation about a longitudinal axis of said rotor and being comprised of a heat conducting material, (iii) a stator adjustably supported by said housing adjacent the rotor, (iv) an adjustment mechanism operatively connected to said stator for moving said stator relative to said rotor between a pumping position wherein the stator holds a portion of the discharge tube in fixed pumping position adjacent to the rotor and a loading position where in the discharge tube can be placed between the stator and rotor, (v) rotatable pinch rollers carried by said rotor and arranged to pinch the discharge tube when the discharge tube is held in pumping position, said pinch rollers moving along the portion of the discharge tube adjacent the rotor to thereby pump product through the discharge tube, and (vi) a control device for controllably rotating the rotor thereby delivering a predetermined amount of product; and (d) insulating material surrounding at least said vertical side walls and said sloped bottom wall said receptacle and said heating means.

2. A dispenser for products which are to be dispensed at elevated temperatures and wherein the product is contained in a container having an outlet with a flexible discharge tube extending therefrom, comprising;

(a) a receptacle having an outlet opening in the lower portion thereof for receiving the container of product with the discharge tube extending through the outlet opening;

(b) a heating element heating the product in the container when received in the receptacle to a desired temperature range and maintaining the temperature of the product in that temperature range for a desired period of time: and (c) a peristaltic pump for compressing a portion of the flexible tube and moving the compressed portion and thereby the heated food product along the tube, said pump including (i) a housing, (ii) a rotor supported in said housing for rotating about a longitudinal axis of said rotor, (iii) a stator adjustably supported by said housing adjacent the rotor, (iv) an adjustment mechanism operatively connected to and moving said stator relative to said rotor between a pumping position wherein the stator holds a portion of the discharge tube in fixed pumping position adjacent to the rotor and a loading position wherein the discharge tube can be placed between the stator and rotor;

(v) rotatable pinch rollers carried by said rotor and arranged to pinch the discharge tube when the discharge tube is held in the pumping position, said pinch rollers moving along the portion of the discharge tube adjacent the rotor to thereby pump product through the discharge tube, and (vi) a control mechanism for controllably rotating the rotor and thereby delivering a predetermined amount of heated product; and (d) means for maintaining the product in the discharge tube in the desired temperature range.

3. An apparatus for the delivery of viscous food material held at elevated temperatures comprising;

(a) a frame shrouded with insulating material;

(b) a receptacle positioned within said frame for holding a container for holding the food material, said receptacle having an opening for receiving said food material and an outlet for dispensing said food material, a portion of said receptacle being made of a heat conductive material;

(c) a peristaltic pump juxtaposed next to a portion of said receptacle, said pump including (i) a flexible tube member communicating with said outlet, (ii) a first member secured and stationary with respect to said frame, (iii) a second member spaced from said first member and movable with respect to said frame between a closed position and an open position said second member made from a heat conducting material and positioned in a heat conducting relationship with said receptacle portion, (iv) a rotating member positioned within a cavity defined by said first and second members, said rotating member together with said second member defining a passage in which a portion of said flexible tube is positioned, said rotating member having a plurality of spaced tube-contacting members for compressing said hose at a point and moving said point of compression along said hose when said second member is in the closed position and abutting said tube member thereby urging said viscous material from said receptacle through said flexible hose and discharging a predetermined amount of said viscous food material;

(d) a heating element positioned within said frame for heating said portion of said receptacle and thereby said viscous food material within the container within said receptacle, said second member when in said closed position being heated by said portion of said receptacle thereby transferring heat to said flexible hose material within said passage; and (e) a cam mechanism operatively connected to said second member for moving said second member between said closed and open positions.

4. The apparatus of claim 3 in which said cam mechanism is an eccentrically mounted rotatable disk positioned within and abutting a rectangular perimeter defined by said second member, said second member being mounted on said frame for sliding movement toward and away from said first member in response to the rotation of said disk whereby said second member moves between said closed and open positions when said disk is rotated m a first direction and second direction, respectively.

5. The apparatus of claim 4 in which said disk is connected to a handle for manually rotating said disk to move said second member between said closed and open positions.

6. The apparatus of claim 3 including a control system and a motor operatively connected to said rotating member for rotating said rotating member, said motor activated by said control system until a predetermined amount of food material has been dispensed by said pump.

7. The apparatus of claim 6 in which at least one of said tube contacting members is compressing said tube when said motor is in an inactive state thereby preventing movement of said food material through said tube.

* * * * *